US005083806A

United States Patent [19]

Brown

[11] Patent Number: 5,083,806

[45] Date of Patent: Jan. 28, 1992

[54] ADULT WALKER FOR SEATED AND STANDING USE

[76] Inventor: M. Theodore Brown, 1415 College Dr., Emporia, Kans. 66801

[21] Appl. No.: 646,190

[22] Filed: Jan. 28, 1991

[51] Int. Cl.[5] ..... B62M 1/00; B62B 7/00

[52] U.S. Cl. ..... 280/87.05; 280/87.051; 248/188.5; 272/70.3; 297/5

[58] Field of Search ..... 280/87.021, 87.041, 280/87.05, 87.051, 47.38, 47.4, 657, 658; 108/107, 146; 135/67; 248/188.5; 272/70.3; 297/5, 6

[56] References Cited

U.S. PATENT DOCUMENTS

| | | | |
|---|---|---|---|
| 126,452 | 5/1872 | Euell | 280/87.051 |
| 1,326,921 | 1/1920 | Dzimitowicz | 297/5 |
| 1,432,612 | 10/1922 | O'Connor | 280/87.051 |
| 1,448,783 | 3/1923 | Blewitt et al. | 135/67 X |
| 1,826,502 | 10/1931 | Brown | 280/87.05 |
| 2,538,324 | 1/1951 | Petrie | 280/87.051 |
| 3,747,596 | 7/1973 | Mills | 272/70.3 |
| 4,225,146 | 9/1980 | Takeuchi | 280/87.051 |
| 4,312,505 | 1/1982 | Engelhart | 272/70.3 |
| 4,342,465 | 8/1982 | Stillings | 280/87.051 |
| 4,770,410 | 9/1988 | Brown | 297/5 X |
| 4,773,639 | 9/1988 | Graves | 272/70.3 |
| 4,890,853 | 1/1990 | Olson | 280/87.021 |
| 4,988,138 | 1/1991 | Donna et al. | 280/87.051 X |

FOREIGN PATENT DOCUMENTS

| | | | |
|---|---|---|---|
| 0144537 | 1/1952 | Australia | 280/87.051 |

OTHER PUBLICATIONS

Walk n'Roll Walker (date unknown).

*Primary Examiner*—Andres Kashnikow
*Assistant Examiner*—Biran L. Johnson
*Attorney, Agent, or Firm*—John R. Flanagan

[57] ABSTRACT

An adult walker includes a mobile frame assembly and a seat and gate assembly. The frame assembly is composed of lower, middle and upper frame sections. The lower frame section includes an annular base member supported above a floor by a plurality of spaced apart swivel wheels. The upper frame section has a horizontal U-shaped support member which supports the seat and gate assembly. The middle frame section has a plurality of legs which extend from the lower frame section upwardly and inwardly toward the center of the frame assembly to position the upper frame section and the seat and gate assembly supported thereon centrally above the annular base member. The lower and upper frame sections have spaced apart mounting posts connected respectively to the annular base member and support member which interfit with opposite ends of the legs of the middle frame section to permit the frame assembly to be assembled and disassembled and to adjust the height of the upper frame section and the seat and gate assembly supported thereon above the floor. The seat and gate assembly includes a back, seat, pivotal gate bar, and detachable retention strap. The back is attached to the upper frame section with the seat suspended from it. The gate bar is mounted for swinging movement between closed and opened positions relative to the front of the support member with the retention strap detachably interconnecting the seat and gate bar.

17 Claims, 3 Drawing Sheets

ADULT WALKER FOR SEATED AND STANDING USE

BACKGROUND OF THE INVENTION

1. Field of the Invention

The present invention generally relates to adult walkers and, more particularly, is concerned with an adult walker for seated and standing use.

2. Description of the Prior Art

Adult walkers and wheelchairs are known in the art which assist the mobility of persons, such as the elderly and disabled, who are unable to walk or move around without assistance. These devices have improved the range of activity of such persons under conditions where assistance by personnel is in limited supply.

Different walkers and wheelchairs found in the prior art are exemplified by the devices disclosed in U.S. Pat. No. 4,312,505 to Engelhart and U.S. Pat. No. 4,890,853 to Olson. The design of a device adapted for use in both walking and seated positions by adults is proposed in the cited Olson patent. A device capable of such use by infants is disclosed in U.S. Pat. No. 4,225,146 to Takeuchi.

However, many walkers and wheelchairs have one or more inherent disadvantages. Among such disadvantages, one is a lack of sufficient support measures in the case of fainting and falling of a person so that close and constant supervision by an attendant is still desirable. Another disadvantage is that too much effort is required to move some devices. A further disadvantage is that other devices involve protective harnesses and supports too complicated for the person to use. Still another disadvantage is that some devices can cause damage to walls and doors, and bruises to a user's feet and ankles.

Consequently, a need still remains for improvements in adult walker designs that will overcome the abovedescribed disadvantages found inherent in prior art devices.

SUMMARY OF THE INVENTION

The present invention provides an adult walker designed to satisfy the aforementioned needs. The adult walker of the present invention embodies a design that reduces falls of users and the need for restraints. The walker has a mobile frame assembly construction which provides stability against tipping over and completely encircles the user. Also, the walker has a seat and gate assembly which deters a person from falling.

The mobile frame assembly of the walker includes a mobile lower frame section, an upper frame section supporting the seat and gate assembly, and a middle frame section. The mobile lower frame section includes an annular ring-shaped base member supported by a plurality of spaced swivel wheels. The annular base member can be padded to cushion impacts with walls and furniture as well as with the user's feet and ankles to reduce the incidence of damage and injury.

The upper frame section has a horizontal U-shaped support member which supports the seat and gate assembly. The middle frame section is composed of a plurality of legs having elbow configurations which extend upwardly and then are inclined inwardly toward the center of the frame assembly to position the upper frame section and seat and gate assembly supported thereon substantially centrally above the annular base member of the lower frame section.

The lower and upper frame sections have a plurality of spaced mounting posts fixedly connected respectively to the annular base member and support member. The mounting posts interfit with opposite ends of the legs of the middle frame section so as to permit the frame assembly to be quickly assembled and disassembled as well as to adjust the height of the seat and gate assembly above the floor upon which the adult walker rests.

The seat and gate assembly includes a vertical back, a U-shaped seat, a pivotal gate bar, and a detachable retention strap. The vertical back is attached to a bight portion of the U-shaped horizontal support member of the upper frame section and the U-shaped seat is suspended from the generally parallel opposite arms of the upper frame section support member. The gate bar at one end is mounted to one of the arms of the support member for pivotal swinging movement between closed and opened positions relative to the other arm of the support member. In the closed position, the gate bar at the opposite end is releasably latched to the other arm of the support member. The retention strap extends between and detachably interconnects the middle of a bottom portion of the seat with the middle of the gate bar.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
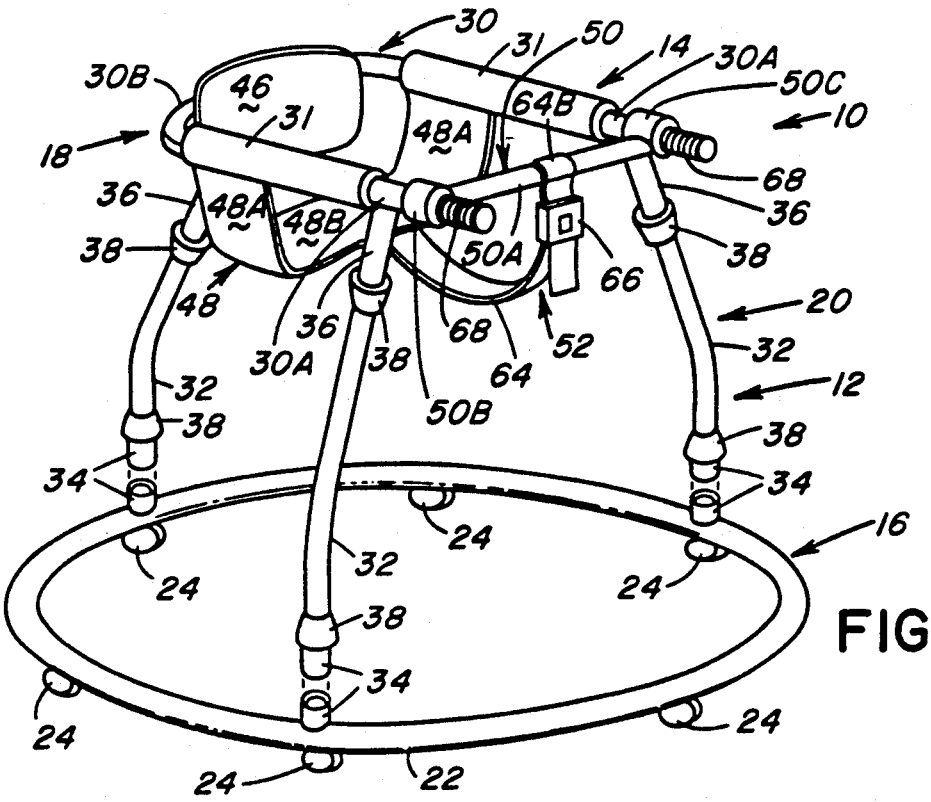
FIG. 1 is a perspective of an adult walker in accordance with the present invention.

In the following description, like reference characters designate like or corresponding parts throughout the several views of the drawings. Also in the following description, it is to be understood that such terms as "top", "bottom", "front", "rear" and the like, are words of convenience and are not to be construed as limiting terms.

Figure 2:
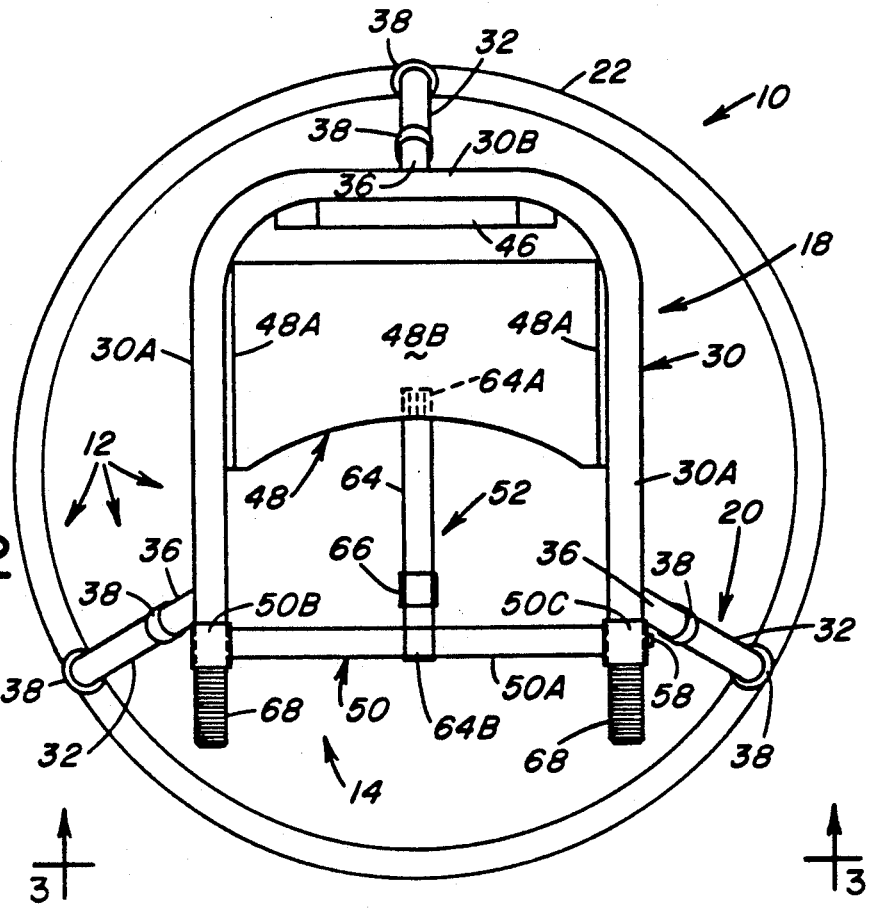
FIG. 2 is a top plan view of the adult walker of FIG. 1.
Figure 3:
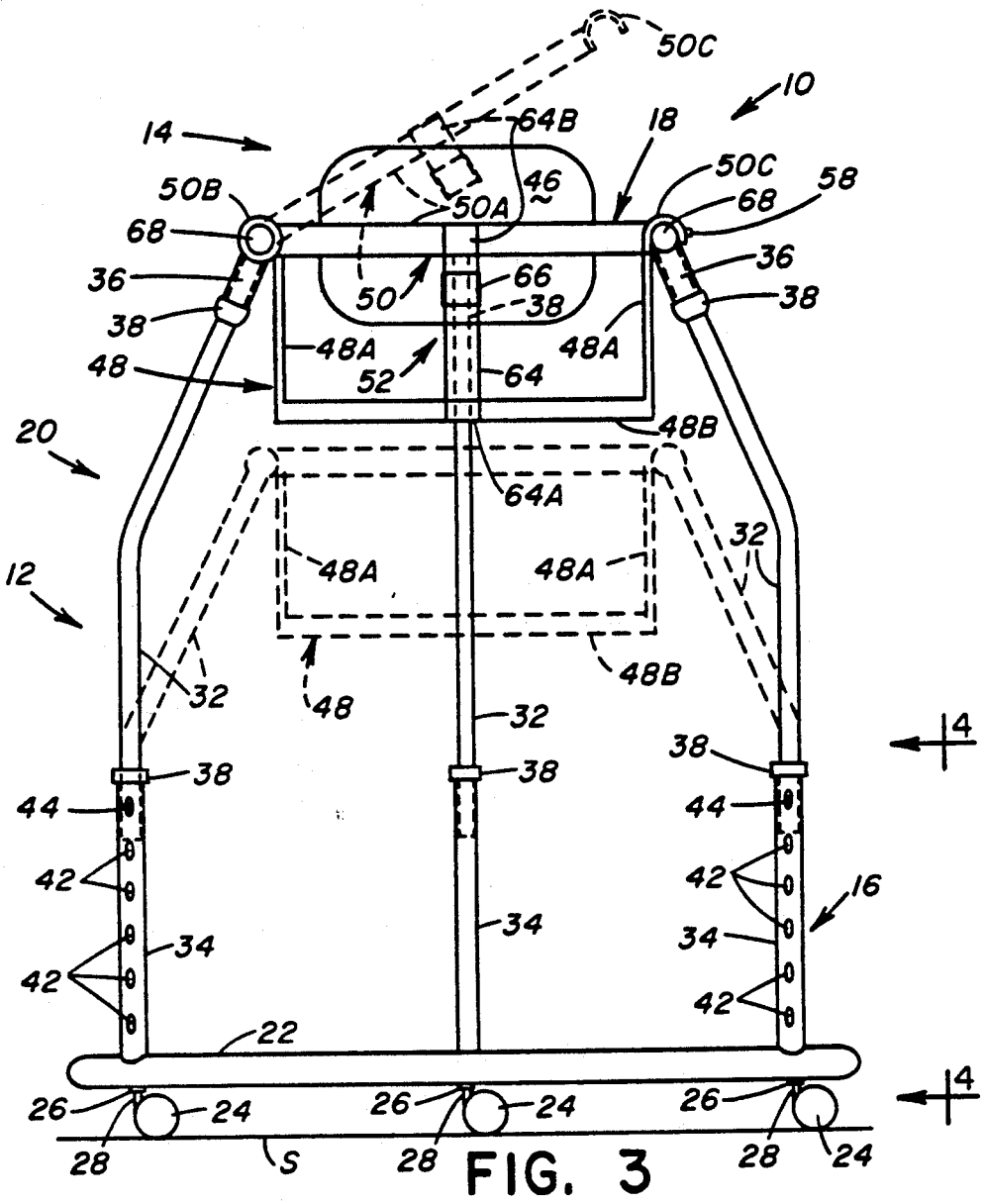
FIG. 3 is a front elevational view of the adult walker as seen along line 3—3 of FIG. 2.

Referring to the drawings, and particularly to FIGS. 1-3, there is illustrated an adult walker of the present invention, generally designated 10. Basically, the adult walker 10 includes a mobile frame assembly 12 and a seat and gate assembly 14. The mobile frame assembly 12 is composed of a mobile lower frame section 16, an upper frame section 18 supporting the seat and gate assembly 14, and a middle frame section 20 located between the lower and upper frame sections 16, 18.

Figure 4:
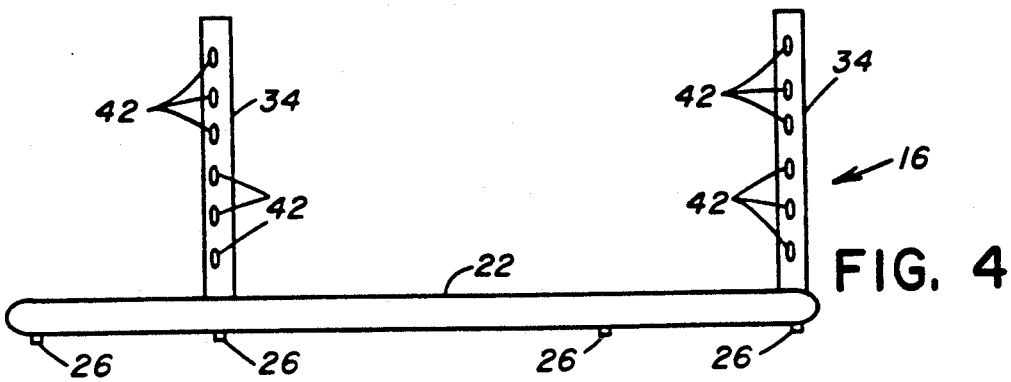
FIG. 4 is a side elevational view of a lower section of the frame assembly of the adult walker as seen along line 4—4 of FIG. 3.

More particularly, referring to FIGS. 1–4, the mobile lower mobile frame section 16 of the frame assembly 12 includes a continuous annular ring-shaped base member 22 supported above a floor or other support surface S by a plurality of spaced wheels 24. The wheels 24 preferably are conventional caster or swivel wheels. As shown in FIG. 4, a plurality of sockets 26 are fixed to the lower side of the annular base member 22 at the locations of the swivel wheels 24 which receive and couple with respective mounting shafts 28 of the swivel wheels 24.

Referring to FIGS. 1–3, 6 and 7, the upper frame section 18 of the mobile frame assembly 12 has a generally horizontal U-shaped support member 30 which supports the seat and gate assembly 14. The U-shaped support member 30 includes a pair of generally parallel side arm portions 30A and a middle rear portion 30B. The middle rear portion 30 extends between and interconnects the rear ends of the arm portions 30A. Padded sleeves 31 (shown only in FIG. 1) are provided on the side arm portions 30A.

Referring to FIGS. 1–3 and 5, the middle frame section 20 of the mobile frame assembly 12 is composed of a plurality of hollow tubular legs 32 having elbow-shaped configurations. The legs 32 extend upwardly and then are inclined inwardly toward the center of the mobile frame assembly 12 so as to position the upper frame section 18 and the seat and gate assembly 14 supported thereon centrally above the annular base member 22 of the lower frame section 16.

Figure 6:
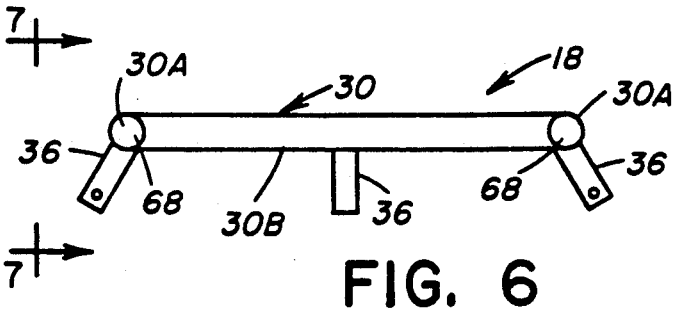
FIG. 6 is a front elevational view of an upper section of the frame assembly of the adult walker of FIG. 3.
Figure 5:
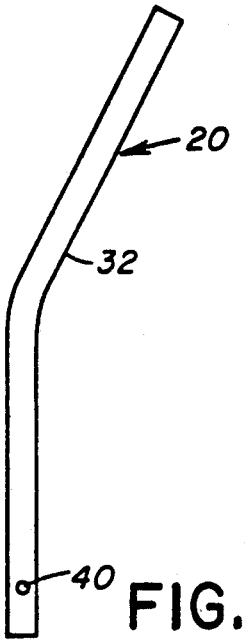
FIG. 5 is a side elevational view of a leg of a middle section of the frame assembly of the adult walker of FIG. 3.
Figure 7:
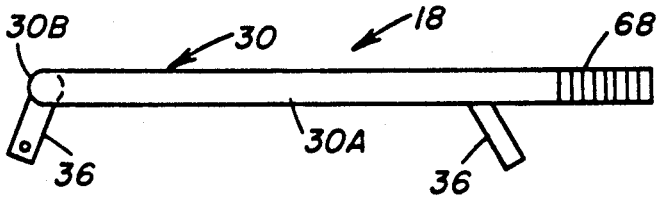
FIG. 7 is a side elevational view of the frame assembly upper section as seen along line 7—7 of FIG. 6.
Figure 8:
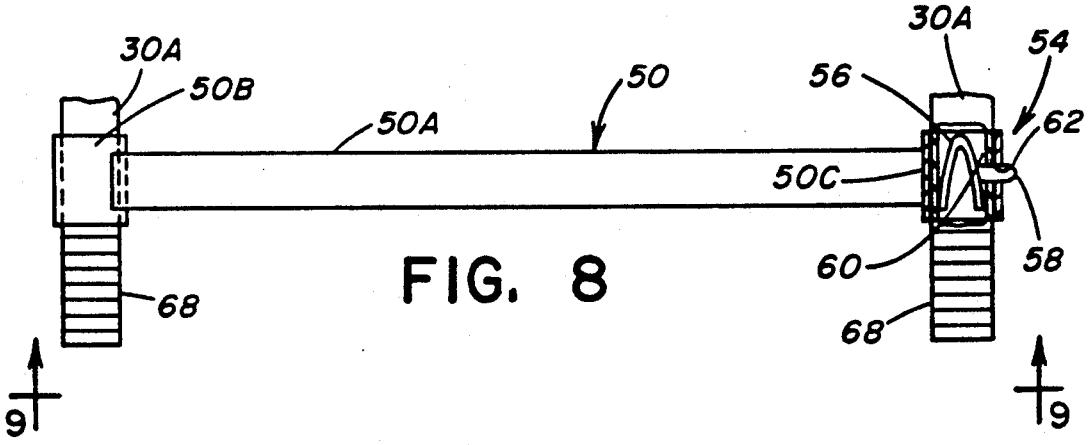
FIG. 8 is an enlarged top plan view of a pivotal gate on the upper section of the frame assembly of the adult walker of FIG. 2.
Figure 9:
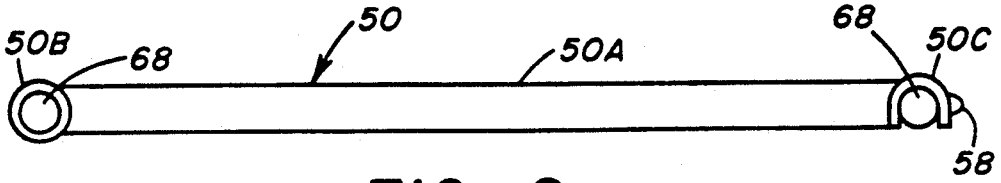
FIG. 9 is a front view of the pivotal gate as seen along line 9—9 of FIG. 8.

Also, referring to FIGS. 4, 6 and 7, the lower and upper frame sections 16, 18 have respective pluralities of spaced apart lower and upper mounting posts 34, 36 fixed respectively to their annular base and support members 22, 30. The lower and upper mounting posts 34, 36 interfit respectively with opposite lower and upper ends of the legs 32 of the middle frame section 20. Annular bushings 38 are installed at the interfitted joints between the legs 32 and the mounting posts 34, 36 to eliminate any looseness between the interfitted parts which otherwise would produce rattling of the assembled parts of the frame assembly 12.

The above-described construction of the mobile frame assembly 12 permits it to be assembled and disassembled easily. Also, the circular shape and large area enclosed by the annular base member 22 of the lower frame section 16 which completely encircles a user, and the locating of the upper frame section 18 above the center of the lower frame section 16 and encompassing a much smaller area, provides the frame assembly 12 with a construction having built-in stability against tipping over. Further, the annular base member 22 can be padded so as to cushion any impacts by it with walls and furniture as well as with a user's feet and ankles to reduce the incidence of damage and injury.

Further, referring to FIGS. 3 and 4, there are means provided on the frame assembly 12 to permit easy adjustment of the height of the seat and gate assembly 14 above the support surface S upon which the adult walker 10 rests in order to accommodate the walker 10 to users of different heights. Such means are single holes 40 defined in the lower end portions of the legs 32 and spaced holes 42 defined in the lower mounting posts 34. By moving the legs 32 relative to the lower mounting posts 34 to align the single holes 40 of the legs 32 with different levels of the holes 42 in the lower mounting posts 34 and insert pins 44 through the aligned holes 40, 42, the height of the upper frame section 18 and the seat and gate assembly 14 can be adjusted above the lower frame section 16 and the surface S supporting the mobile frame assembly 12 at different spaced levels between the upper solid line and lower dashed line positions seen in FIG. 1.

Referring to FIGS. 1–3, 8 and 9, the seat and gate assembly 14 includes a generally vertical back 46, a generally U-shaped seat 48, a pivotal gate bar 50, and a detachable retention device 52. The vertical back 46 is attached on the rear bight portion 30B of the U-shaped horizontal support member 30 of the upper frame section 18. The U-shaped seat 48 has a pair of generally vertical opposite side portions 48A and a generally horizontal bottom portion 48B extending between and interconnecting the side portions 48A. The seat 48 at its side portions 48A is suspended from the generally parallel opposite arm portions 30A of the support member 30 of the upper frame section 18.

The gate bar 50 is an elongated tube 50A having a cylindrical hinge 50B at one end and an inverted U-shaped bracket 50C at the opposite end. The hinge 50B of the gate bar 50 is pivotally mounted to the forward end of the left arm portion 30A of the support member 30. The gate bar 50 undergoes pivotally swinging movement between closed and opened positions relative to the right arm portion 30A of the support member 30, as respectively shown in solid line and dashed line positions in FIG. 3. In the closed position, the inverted U-shaped bracket 50C of the gate bar 50 fits over the forward end of the right arm portion 30A of the support member 30.

A latch 54 is provided at the bracket 50C and the forward end of the right arm portion 30A. The latch 54 includes a v-shaped spring 56 having an actuating button 58 on one leg. The spring 56 is disposed within the forward end of the right arm portion 30A with its button 58 aligned with respective aligned holes 60, 62 in the right arm portion 30A and the bracket 50C. By pressing on the actuating button 58, the gate bar 50 is released and unlatched from the right arm portion 30A and can then be pivoted upwardly to the dashed line position seen in FIG. 3. Upon lowering the gate bar 50, the bracket 50C inserts downwardly over the right arm portion 30A and when the holes 60, 62 become aligned the button 58 will again project throught the hole 62 in the bracket 50C due to the bias of the spring 56.

The retention device 52 of the seat and gate assembly 14 is an elongated flexible strap 64 connected at one end 64A to a middle location of the bottom portion 4BB of the seat 4B, and an attaching means 66 in the form of a buckle for releasably fastening an opposite end 64B of the strap 64 to a middle location on the gate bar 50. When fastened to the gate rod 50, the retention strap 64 will pass between a person's legs when the person is seated on the seat 48 and thereby deter a person from falling from the seat 48.

A pair of handles 68 are attached to and project forwardly from the forward ends of the side arm portions 30A of the support member of the upper frame section 18. The handles 68 can be used by an attendant to push the adult walker 10 when necessary.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

Having thus described the invention, what is claimed is:

1. An adult walker, comprising:

(a) a mobile frame assembly composed of a mobile lower frame section, said lower frame section including a base member and a plurality of wheels supporting said base member above a surface supporting said mobile frame assembly, an upper frame section, and means extending between and interconnecting said lower and upper frame sections, said upper frame section including a horizontal support member having a pair of generally parallel arm portions and a middle rear portion extending between and interconnecting said arm portions; and (b) a seat and gate assembly including a seat suspended from and between said arm portions of said support member, a gate mounted to said arm portions of said support member forwardly of said seat and being pivotally movable between closed and opened positions relative to said arm portions to respectively prevent and permit movement of a person from and to said said seat, and means extending between and detachably interconnecting said seat with said gate so as to pass between a person's legs when the person is seated on said seat;

(c) said means interconnecting said lower and upper frame sections being a middle frame section including a plurality of spaced apart legs, each said leg having an elbow configuration defined by a lower portion extending upwardly form said lower frame section and an upper portion which is inclined inwardly toward a center of said frame assembly to position said upper frame section and said seat and gate assembly supported thereon centrally above said lower frame section.

2. The adult walker of claim 1 wherein said seat and gate assembly further includes a back mounted to said rear portion of said support member of said upper frame section.

3. The adult walker of claim 1 wherein said gate is pivotal bar having one end mounted to one of said arm portions of said support member for generally vertical pivotal movement between said closed and opened positions relative to the other of said arm portions of said support member, said gate bar including a latch at an opposite end to releasably secure said gate bar to said other arm portion of said support member when said gate is in said closed position.

4. The adult walker of claim 1 wherein said detachable interconnecting means is a retentions trap connected at one end to a middle of a bottom portion of said seat, and an attaching means for releasably fastening an opposite end of said strap to a middle of said gate.

5. An adult walker, comprising:

(a) a mobile frame assembly composed of a mobile lower frame section, an upper frame section, and means extending between and interconnecting said lower and upper frame sections, said upper frame section including a horizontal support member having a pair of generally parallel arm portions and a middle rear portion extending between and interconnecting said arm portions, said lower frame section including an annular base member and a plurality of wheels supporting said annular base member above a surface supporting said mobile frame assembly and (b) a seat and gate assembly including a seat suspended from and between said arm portions of said support member, a gate mounted to said arm potions of said support member forwardly of said seat and being pivotally movable between closed and opened positions relative to said arm portions to respectively prevent and permit movement of a person from and to said seat, and means extending between and detachably interconnecting said seat with said gate so as to pass between a person's legs when the person is seated on said seat;

(c) said means interconnecting said lower and upper frame sections being a middle frame section including a plurality of spaced apart legs, each said leg having an elbow configuration defined by a lower portion extending upwardly form said annular base member of said lower frame section and an upper portion inclined inwardly toward a center of said annular base member to position said upper frame section and said seat and gate assembly supported thereon centrally above said annular base member of said lower frame section.

6. The adult walker of claim 5 wherein:

said lower frame section includes a plurality of lower spaced apart mounting posts fixedly connected to said annular base member;

said upper frame section includes a plurality of upper spaced apart mounting posts fixedly connected to said support member;

said lower and upper mounting posts removably interfitted with opposite ends of said legs of said middle frame section to permit said frame assembly to be assembled and disassembled.

7. The adult walker of claim 6 wherein said frame assembly includes means on said legs and lower mounting posts for adjusting the interfitted position of said legs relative to said lower mounting posts and thereby the height of said upper frame section and the seat and gate assembly above said lower frame section and a surface supporting said frame assembly.

8. An adult walker, comprising:

(a) a seat and gate assembly; and (b) a mobile frame assembly composed of a mobile lower frame section, an upper frame section supporting said seat and gate assembly, and a middle frame section;

(c) said lower frame section including an annular base member and a plurality of wheels supporting said base member above a surface supporting said mobile frame assembly;

(d) said upper frame section including a support member supporting said seat and gate assembly, said support member having a pair of generally parallel arm portions and a rear middle bight portion interconnecting said arm portions, a gate mounted to said arm portions of said support member forwardly of said seat and being pivotally movable between closed and opened positions relative to said arm portions to respectively prevent and permit movement of a person from and to said seat;

(e) said middle frame section including a plurality of legs, each said leg having an elbow configuration defined by a lower portion extending upwardly form said annular base member and an upper portion inclined inwardly toward a center of said annular base member to position said upper frame section and said seat and gate assembly supported thereon centrally above said annular base member of said lower frame section.

9. The adult walker of claim 8 wherein said lower frame section includes a plurality of lower spaced apart mounting posts fixedly connected to said annular base member.

10. The adult walker of claim 9 wherein said upper frame section includes a plurality of upper spaced apart mounting posts fixedly connected to said support member, said lower and upper mounting posts being removably interfitted with opposite ends of said legs of said middle frame section to permit said frame assembly to be assembled and disassembled.

11. The adult walker of claim 9 wherein said frame assembly includes means on said legs and lower mounting posts for adjusting the interfitted position of said legs relative to said lower mounting posts and thereby the height of said upper frame section and the seat and gate assembly above said lower frame section and the surface supporting said frame assembly.

12. The adult walker of claim 8 wherein said seat and gate assembly includes a back mounted to said bight portion of said support member of said upper frame section.

13. The adult walker of claim 8 wherein said seat and gate assembly includes a U-shaped seat suspended from said arm portions of said support member of said upper frame section.

14. The adult walker of claim 8 wherein said seat and gate assembly includes a pivotal gate bar having one end mounted to one of said arm portions of said support member for pivotal swinging movement between closed and opened positions relative to the other of said arm portions of said support member, said gate bar including a latch at an opposite end to releasably secure said gate bar to said other arm portion of said support member when said gate is in said closed position.

15. The adult walker of claim 14 wherein said seat and gate assembly also includes handles attached to said arm portions of said support member and extending forwardly from said pivotal gate bar.

16. The adult walker of claim 8 wherein said seat and gate assembly includes:

a seat suspended from and between said arm portions of said support member;

a gate bar mounted to said arm portions of said support member forwardly of said seat and being pivotally movable between closed and opened positions relative to said arm portions to respectively prevent and permit movement of a person from and to said seat; and means extending between and detachably interconnecting said seat with said gate bar so as to pass between a person's legs when the person is seated on said seat.

17. The adult walker of claim 16 wherein said interconnecting means includes:

a retention strap connected at one end to a middle of a bottom portion of said seat; and an attaching means for releasably fastening an opposite end of said strap to a middle of said gate bar.

* * * * *